US005205591A

United States Patent [19]

Lorenz

[11] Patent Number: 5,205,591

[45] Date of Patent: Apr. 27, 1993

[54] GREETING CARD SYSTEM FOR COLLEGES AND OTHER ORGANIZATIONS

[76] Inventor: Geoffrey R. Lorenz, P.O. Box 802, Dayton, Ohio 45401-0802

[21] Appl. No.: 678,014

[22] Filed: Apr. 1, 1991

[51] Int. Cl.[5] ..... B42D 15/00

[52] U.S. Cl. ..... 283/117; 40/124.1

[58] Field of Search ..... 283/117; 446/150, 147; 40/124.1

[56] References Cited

U.S. PATENT DOCUMENTS

| | | | |
|---|---|---|---|
| 1,879,007 | 9/1932 | Anderton | 283/117 |
| 2,145,794 | 1/1939 | Huber | 146/150 |
| 4,404,764 | 9/1983 | Wills et al. | 283/117 X |

*Primary Examiner*—Mark Rosenbaum
*Assistant Examiner*—Willmon Fridie, Jr.
*Attorney, Agent, or Firm*—Jacox & Meckstroth

[57] ABSTRACT

A series of white greeting cards are preprinted with substantially different full color artwork in the form of pictures associated with a particular day of a celebration, and each of the cards has a set of three spaced identification zones which have the same location on all of the cards and form part of the different pictures. All of the identification zones on all of the cards are printed with corresponding information which identifies a particular organization, and the information is printed in a color associated with the organization. In the illustrated embodiment, the pictures are associated with the celebration of Christmas, and two of the identification zones on each card have the shapes of a tied ribbon bow and a scroll each enclosing the identifying information of a college or university and printed in a color associated with the college or university.

16 Claims, 1 Drawing Sheet

GREETING CARD SYSTEM FOR COLLEGES AND OTHER ORGANIZATIONS

BACKGROUND OF THE INVENTION

In the art of custom printed greeting cards for an organization such as a university or college, it is known to pre-print greeting cards with pictures in full color and then later print the cards with information which identifies the college or university. The information is usually the name or initials of the college or university, and the name or initials may be printed in a color associated with the college or university. Each card requires its own color printing plate.

With respect to each college or university or other organization, it has been found desirable to provide a potential greeting card customer with a selection from a variety of greeting cards having different full color pictures associated with a particular day of celebration, such as Christmas, and with all of the cards custom printed with information which identifies and/or is associated with the organization. However, the cost of custom printing a small order or batch of a variety of cards, including the cost of different color printing plates for each card, results in the retail prices for the custom printed cards being substantially higher than the retail prices of conventional non-custom printed greeting cards which do not identify the organization.

SUMMARY OF THE INVENTION

The present invention is directed to a greeting card system which is ideally suited for sale to individuals associated with a college or university or other organization and which provides each individual with a selection from a variety of full color and lower cost custom printed greeting cards which identify the organization. In accordance with one embodiment of the invention, a series of eight or more greeting cards are day of celebration such as Christmas, Easter or Graduation. Each of the cards has a set or plurality of spaced identification zones which form portions of the different pictures on the cards and which identify the organization. The identification zones on each card have the same locations as the identification zones on each of the other cards, and the zones on all of the cards are custom printed in one color, preferably a color associated with the organization. Thus the greeting card system of the invention provides for custom printing only the identification zones or picture positions on a variety of preprinted greeting cards for a particular organization, and the printing is performed with only one color plate corresponding to a color associated with the organization.

Other features and advantages of the invention will be apparent from the following description, the accompanying drawing and the appended claims.

DESCRIPTION OF THE PREFERRED EMBODIMENT

Figure 1:
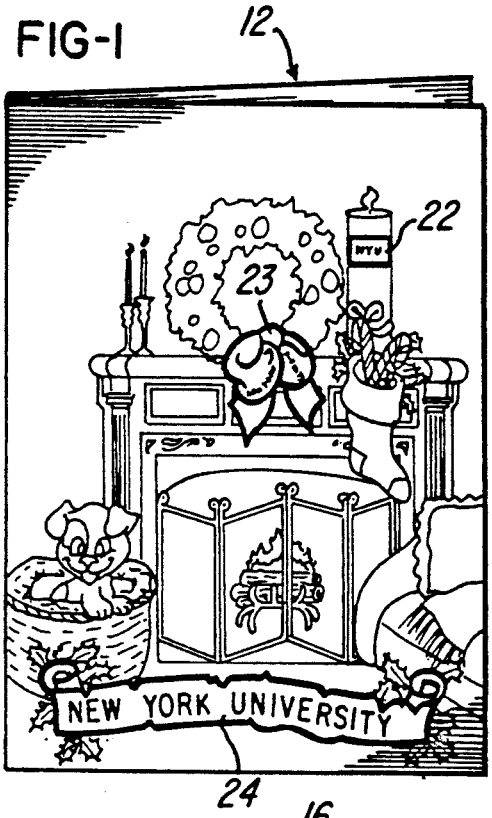
FIGS. 1–4 illustrate four examples of different greeting cards which are printed in accordance with the invention for four different schools, and each of the cards has a corresponding set of three spaced identification zones which are custom printed with information which identifies the corresponding school.
Figure 2:
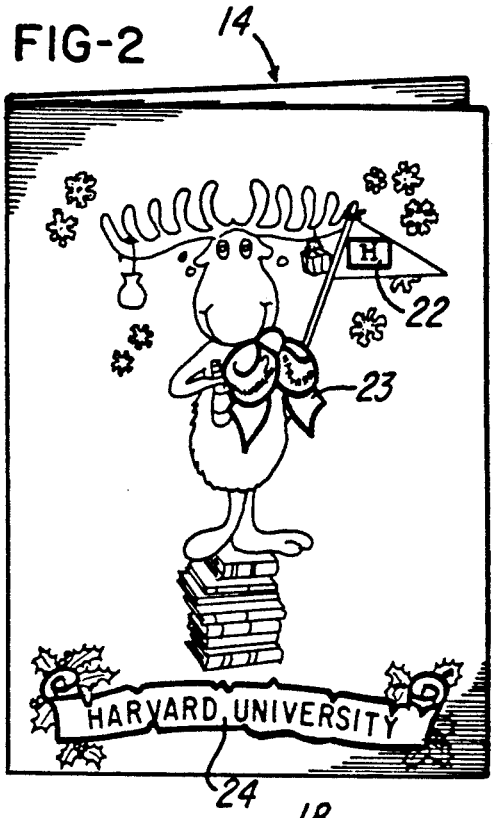
Figure 3:
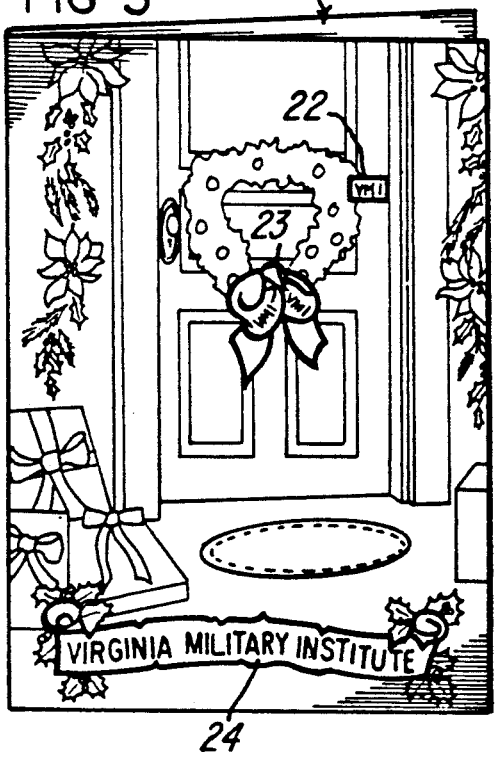
Figure 4:
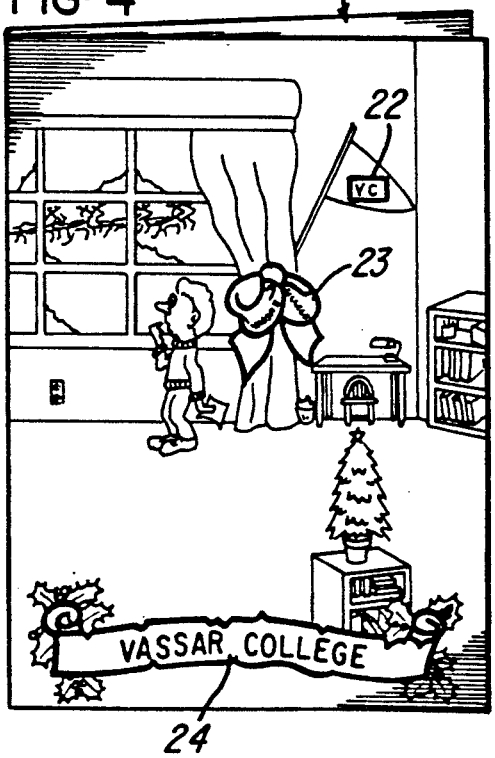

FIGS. 1–4 show the front sheets of four preprinted greeting cards 12, 14, 16 and 18 which are cut from a large sheet or web of white card stock or paper-like material. The sample cards are associated with the celebration of Christmas and are subsequently printed with information corresponding to four different colleges or universities. The greeting cards 12, 14, 16 and 18 may be single cards or folded cards (as shown) with messages printed on the backside of the single cards or on the second sheets of the folded cards. Each of the greeting cards is preprinted in multiple or full color with the artwork in the form of pictures associated with a particular day or time of celebration such as Christmas. In general, the artwork or pictures are clearly apparent and require no detail description.

In accordance with the present invention, each of the preprinted greeting cards 12, 14, 16 and 18 includes a plurality or set of three spaced identification zones 22, 23 and 24 which have the same locations on all of the cards and form part of the different full color artwork or pictures. The zones 22–24 on each card identify a particular college, university or other organization and are printed with a single color associated with the organization. The identification zone 22 on each greeting card is in the form of a rectangular block which is printed with a background color associated with the organization, and the initials of the organization appear in white which is the basic color of the paper or card stock.

The identification zone 23 on each card is in the form of a tied ribbon bow, and the color of the bow is printed in the same color as the background of the zone 22. The name or initials of the organization appear in white within the ribbon bow, in the same manner as the initials appear in white in the block zone 22. The third identification zone 24 on each of the greeting cards 12, 14, 16 and 18 is in the form of a banner or scroll, and the name of the organization is printed with letters in a color which is the same as the background color of the identification zones 22 and 23.

Referring more specifically to the greeting cards shown on the drawing, the pictures are preprinted in full color on a high volume of the cards with the exception of the identifying information in the identification zones 22–24. The card 12 is a sample of eight different preprinted cards which are later printed with a single color purple, a preprinted cards which are later printed with a single color purple, a color associated with NEW YORK UNIVERSITY. Thus the background of the zone 22, the tied ribbon bow of the zone 23 and the letters NEW YORK UNIVERSITY in the zone 24 are all printed in the single color purple. The single color printed in the identification zones 22–24 on the greeting cards 14 and 18 is a maroon color which is a color associated with HARVARD UNIVERSITY and VASSAR COLLEGE, and the identification zones 22–24 on the greeting card 16 are custom printed in the color crimson which is a color associated with VIRGINIA MILITARY INSTITUTE.

From the drawing of the above description, it is apparent that a greeting card system printed in accordance with the present invention, provides desirable features and advantages. For example, by preprinting a set of series of at least three or six multiple color or full color pictures on a high volume of greeting cards without printing the identification zones 22–24, and then subsequently custom printing the identification zones in a color on a substantially lower volume associated with a particular organization, the total cost for providing a variety of custom printed greeting cards for each organization, is substantially reduced. That is, by custom printing only the corresponding identification zones 22–24 in a single color on a batch of different cards, only one color plate is required for all of the cards, thereby reducing the custom printing costs by approximately twenty percent of the normal cost for custom printing greeting cards.

Thus the greeting card system of the invention and the method of printing the cards, provide for offering a variety of custom printed greeting cards to a retail bookstore at a college or university at a price significantly lower than the price of conventional greeting cards which are custom printed for the organization. As a specific example, a series of eight greeting cards with completely different pictures associated with the celebration of Christmas, are printed in large volume for all of the a few hundred of the eight different greeting cards are later custom printed for a particular college or university and with a color associated with the organization. This custom printing operation is very economical since only one color printing plate is required to print the identification zones 22–24 on all of the cards.

It is understood that the greeting cards 12, 14, 16 and 18 and the full color pictures on the cards and the specific identification zones 22–24 are shown merely for illustrating the greeting card system and method of printing in accordance with the invention. Thus other greeting cards having other artwork or pictures and multiple picture portions or identification zones with the same locations on all of the different cards, is also within the scope of the invention. Furthermore, while the form of the greeting cards and their method of printing herein described constitute a preferred embodiment of the invention, it is to be understood that the invention is not limited to the precise form and method described, and that changes may be made therein without departing from the scope and spirit of the invention as defined in the appended claims.

The invention having thus been described, the following is claimed:

1. A greeting card system for sale to a store which sells articles to individuals associated with a college or other organization, said system comprising a plurality of generally rectangular cards of paper-like material and having substantially the same corresponding height and width, said cards having printed thereon substantially different multiple color artwork in the form of pictures associated with a particular time of celebration, each of said cards having a set of spaced identification portions forming parts of the corresponding said pictures, said identification portions of each of said cards having the same locations as said identification portions of each of the other said cards, and corresponding said identification portions of all of said cards having custom printed thereon the same corresponding information identifying said organization for providing the individual with a selection from a variety of custom printed multiple color greeting cards associated with the organization while minimizing the cost of producing said custom printed cards.

2. A greeting card system as defined in claim 1 wherein said custom printed information on each of said cards at each of said identification portions comprises a single color associated with said organization.

3. A greeting card system as defined in claim 1 wherein at least three of said cards have printed thereon substantially different said multiple color pictures, and each of said cards has at least two of said spaced identification portions and corresponding said custom printed information.

4. A greeting card system as defined in claim 1 wherein each of said cards has at least three of said spaced identification portions and corresponding said custom printed information, and said identification portions and corresponding said custom printed information on each said card form portions of said picture on said card.

5. A greeting card system as defined in claim 1 wherein one of the corresponding said identification portions of each of said cards is located within a lower portion of said card, and the corresponding said information comprises the name of said organization.

6. A greeting card system as defined in claim 1 wherein one of the corresponding said identification portions of each of said cards comprises the design of a tied ribbon bow, and the corresponding said information identifies said organization within said bow.

7. A greeting card system as defined in claim 6 wherein all of said bows on all of said cards are printed with a single color associated with the organization.

8. A greeting card system as defined in claim 1 wherein said series of cards have printed thereon said substantially different artwork in the form of pictures associated with the celebration of Christmas.

9. A greeting card system as defined in claim 1 wherein all of the corresponding said identification portions of all of said cards are printed with the same corresponding said information in a single color associated with the organization.

10. A greeting card system as defined in claim 1 wherein all of said cards have a white base color, and all of said identifying portions of all of said cards include said white base color of said cards and a color associated with the organization.

11. A greeting card system as defined in claim 1 wherein one of the corresponding said identification portions of all of said cards comprises a scroll, and the corresponding custom printed information comprises the name of the organization within the scroll.

12. A greeting card system for sale to a store which sells articles to individuals associated with a college or other organization, said system comprising a plurality of generally rectangular cards of paper-like material and having substantially the same corresponding height and width, said cards having printed thereon substantially different multiple color artwork in the form of pictures associated with a particular time of celebration, each of said cards having a plurality of spaced identification portions forming parts of the corresponding said pictures, said identification portions of each of said cards having the same locations as said identification portions of each of the other said cards, corresponding said identification zones on all of said cards having custom printed thereon the same corresponding information identifying said organization, and said custom printed information on each of said cards at each of said identification portions is printed with a common single color associated with said organization, for providing the individual with a selection from a variety of custom printed multiple color greeting cards associated with the organization while minimizing the cost of producing said custom printed cards.

13. A greeting card system as defined in claim 12 wherein at least six of said cards have printed thereon substantially different said pictures of said multiple color artwork, and each of said cards has at least two of said spaced identification portions and corresponding said custom printed information.

14. A greeting card system as defined in claim 12 wherein each of said cards has at least three of said spaced identification portions and corresponding said custom printed information in said single color.

15. A method of producing greeting cards for sale by a store which sells articles to individuals associated with a college or other organization, comprising the steps of cutting a sheet of paper-like material to form a plurality of generally rectangular cards having substantially the same corresponding height and width, printing on the cards substantially different multiple color artwork in the form of pictures associated with a particular time of celebration, defining on each of the cards a plurality of spaced identification portions forming parts of the corresponding pictures, arranging the identification portions of all of the cards at the same corresponding locations, and then custom printing the corresponding identification portions of all of the cards with information identifying the organization for providing the individual with a selection from a variety of custom printed greeting cards associated with the organization while minimizing the cost of producing the custom printed cards.

16. A method as defined in claim 15 wherein the custom printing of all of the identication portions of each of the cards is performed with a single color associated with the organization.

* * * * *